US006531820B1

(12) United States Patent
Lee et al.

(10) Patent No.: US 6,531,820 B1
(45) Date of Patent: Mar. 11, 2003

(54) PLASMA DISPLAY DEVICE INCLUDING GROOVES CONCENTRATING AN ELECTRIC FIELD

(75) Inventors: Byung-hak Lee, Cheonan (KR); Eun-gi Heo, Cheonan (KR); Min-sun Yoo, Cheonan (KR); Yoshinori Anzai, Cheonan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/533,787

(22) Filed: Mar. 24, 2000

(30) Foreign Application Priority Data

Mar. 31, 1999 (KR) ..... 99-11260

(51) Int. Cl.[7] ..... H01J 17/49
(52) U.S. Cl. ..... 313/586; 313/582; 313/485
(58) Field of Search ..... 313/586, 582, 313/485

(56) References Cited

U.S. PATENT DOCUMENTS 4,249,105 A * 2/1981 Kamegaya et al. ..... 313/346 R
4,703,225 A * 10/1987 Sohn ..... 313/582
5,742,122 A 4/1998 Amemiya et al. ..... 313/582

* cited by examiner

*Primary Examiner*—Sandra O'Shea
*Assistant Examiner*—Guiyoung Lee
(74) *Attorney, Agent, or Firm*—Leydig, Voit & Mayer, Ltd.

(57) ABSTRACT

A plasma display device includes a first substrate, an address electrode formed on an upper surface of the fist substrate, a first dielectric layer formed on the upper surface of the first substrate and embedding the address electrode, a second substrate which is transparent and forms a discharge space by being coupled to the first substrate, a plurality of maintaining electrodes formed on a lower surface of the second substrate to form a predetermined angle with the address electrode, each of the maintaining electrodes including first and second electrodes, a second dielectric layer formed on the second substrate where the maintaining electrodes are formed and embedding the maintaining electrodes, at least a portion where an electrical field is concentrated formed between the first and second electrodes constituting the maintaining electrodes, and a partition installed between the first and second substrates for sectioning the discharge space.

11 Claims, 10 Drawing Sheets

PLASMA DISPLAY DEVICE INCLUDING GROOVES CONCENTRATING AN ELECTRIC FIELD

BACKGROUND OF THE INVENTION

1. Field of the Invention

The present invention relates to a plasma display device, and more particularly, to a plasma display device having an improved dielectric layer where a maintenance electrode is embedded and a method of manufacturing the same.

2. Description of the Related Art

A general discharging device includes at least a pair of electrodes and discharge is generated when a voltage is applied to the electrodes. As an example of the discharging device, there is a discharge lamp such as a fluorescent lamp, a gas laser generating apparatus, and a plasma display device.

Due to superior display performance such as large display capacity, high brightness, high contrast, and wide viewing angle, the plasma display device is widely recognized as a flat panel display panel having a performance close to a cathode ray tube.

The plasma display device is classified into a direct current plasma display device panel and an alternating current plasma display panel according to its operation principle. Also, the plasma display device is divided into an opposing discharge type and a surface discharge type according to configuration of electrodes.

FIG. 1 is a view showing an example of a surface discharge type plasma display device of the above discharge type plasma display device.

As shown in the drawing, a plasma display device includes a substrate 10, an address electrode 11 formed on the substrate 10, a dielectric layer 12 formed on the substrate 10 where the address electrode 11 is formed, a partition 13 formed on the dielectric layer 12 for maintaining a discharge distance and preventing electrical and optical cross talk between cells, and a front substrate 16 coupled to the substrate where the partition 13 is formed and having maintaining electrodes 14 and 15 of a predetermined pattern formed on the bottom surface thereof to cross the address electrode 11. A fluorescent layer 17 is formed at at least one side inside a discharge space sectioned by the partition 13. A dielectric layer 18 and a protective layer 19 in which the electrodes are embedded are formed on the bottom surface of the front substrate 16. A discharge gas mixed with neon (Ne) and xenon (Xe) is injected into the discharge space.

In the plasma display device having the above structure, the driving method is divided into driving for an address discharge and driving for a maintaining discharge. The address discharge is generated due to a difference in electrical field is con between the address electrode 11 and the maintaining electrode 14 (80V−(−170V)=250V). At this time, wall charges are formed. The maintaining discharge is generated due to a difference in electrical potential between the maintaining electrodes 14 and 15 disposed at the discharge space where wall charges are formed. The maintaining discharge becomes a main discharge for displaying an actual image.

The maintaining discharge generated due to a difference in electrical potential applied between the maintaining electrodes 14 and 15 becomes weak as time passes. This is because the initial discharge voltage must be over 160 V in general since the distance between the maintaining electrodes 14 and 15 is about 80–100 $\mu$m in an electrode structure of a conventional surface discharge type AC plasma display panel.

When the initial discharge voltage becomes great, much electrical power is consumed and simultaneously the rated capacity of a driving circuit becomes great. Also, induced potential is generated to an adjacent electrode, which causes cross talk. When the distance between the maintaining electrodes 14 and 15 is narrowed to lower the initial discharge voltage, the electrostatic capacity becomes too large.

Alternatively, the quantity of Xe in the discharge gas is increased to increase the efficiency of discharge. However, since the initial discharge voltage becomes great, there is a limit in increasing the quantity of Xe.

A surface discharge type plasma display device to solve the above problems is disclosed in U.S. Pat. No. 5,742,122. In the surface discharge type plasma display device, as shown in FIG. 2, the thickness T1 of a dielectric layer 23 formed on an upper surface of a transparent electrode 22 of a first substrate 21 is thinner than the thickness T2 of the dielectric layer 23 corresponding to a bus electrode 24 formed on and parallel to the transparent electrode 22.

In the above surface discharge type plasma display device, by removing ineffective discharge on the bus electrode 24, the efficiency of light emission can be improved while reducing power consumption and preventing cross talk between pixels. However, since the dielectric layer 23 has a uniform thickness on an upper surface of the transparent electrode, there is a limit in reducing the initial discharge voltage.

SUMMARY OF THE INVENTION

To solve the above problems, it is an objective of the present invention to provide a plasma display device in which an electrical field is concentrated on a predetermined position between maintaining electrodes or at an area corresponding to the maintaining electrode so that the initial discharge voltage is reduced and a method of forming a dielectric layer having a portion where an electrical field is concentrated.

It is another objective of the present invention to provide a method of manufacturing a plasma display device in which the quantity of Xe in a discharge gas is increased to improve the efficiency of light emission and a dielectric layer having a portion where an electrical field is concentrated in the plasma display device.

Accordingly, to achieve the above objective, there is provided a plasma display device which comprises a first substrate, an address electrode formed on an upper surface of the fist substrate, a first dielectric layer formed on the upper surface of the first substrate and embedding the address electrode, a second substrate which is transparent and forms a discharge space by being coupled to the first substrate, a plurality of maintaining electrodes formed on a lower surface of the second substrate to form a predetermined angle with the address electrode, each of the maintaining electrodes including first and second electrodes, a second dielectric layer formed on the second substrate where the maintaining electrodes are formed and embedding the maintaining electrodes, at least a portion where an electrical field is concentrated formed between the first and second electrodes constituting the maintaining electrodes, and a partition installed between the first and second substrates for sectioning the discharge space.

It is preferred in the present invention that said portion where an electrical field is concentrated includes a groove formed between said first and second electrodes, and that said groove is formed between said first and second electrodes in a discontinuous pattern.

To achieve another aspect of the above objective, there is provided a plasma display device which comprises a first substrate, an address electrode formed on an upper surface of the fist substrate, a first dielectric layer formed on the upper surface of the first substrate and embedding the address electrode, a second substrate which is transparent and forms a discharge space by being coupled to the first substrate, a plurality of maintaining electrodes formed on a lower surface of the second substrate to form a predetermined angle with the address electrode, each of the maintaining electrodes including first and second electrodes, a second dielectric layer formed on the second substrate where the maintaining electrodes are formed and embedding the maintaining electrodes, at least one portion where an electrical field is concentrated formed at an area corresponding to the first and second electrodes constituting the maintaining electrodes, and a partition installed between the first and second substrates for sectioning the discharge space.

To achieve the second objective, there is provided a method of manufacturing a dielectric layer having a portion where an electrical field is concentrated of a plasma display device, which is accomplished by forming a plurality of maintaining electrodes on an upper surface of a substrate, each of the maintaining electrodes being constituted by a pair of first and second electrodes, forming a lower dielectric layer on an upper surface of the substrate where the maintaining electrodes are formed, printing an upper dielectric layer for forming a groove in a continuous or discontinuous pattern at a portion on an upper surface of the lower dielectric layer and between the first and second electrodes, and curing the upper and lower dielectric layers by burning the same.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 1:
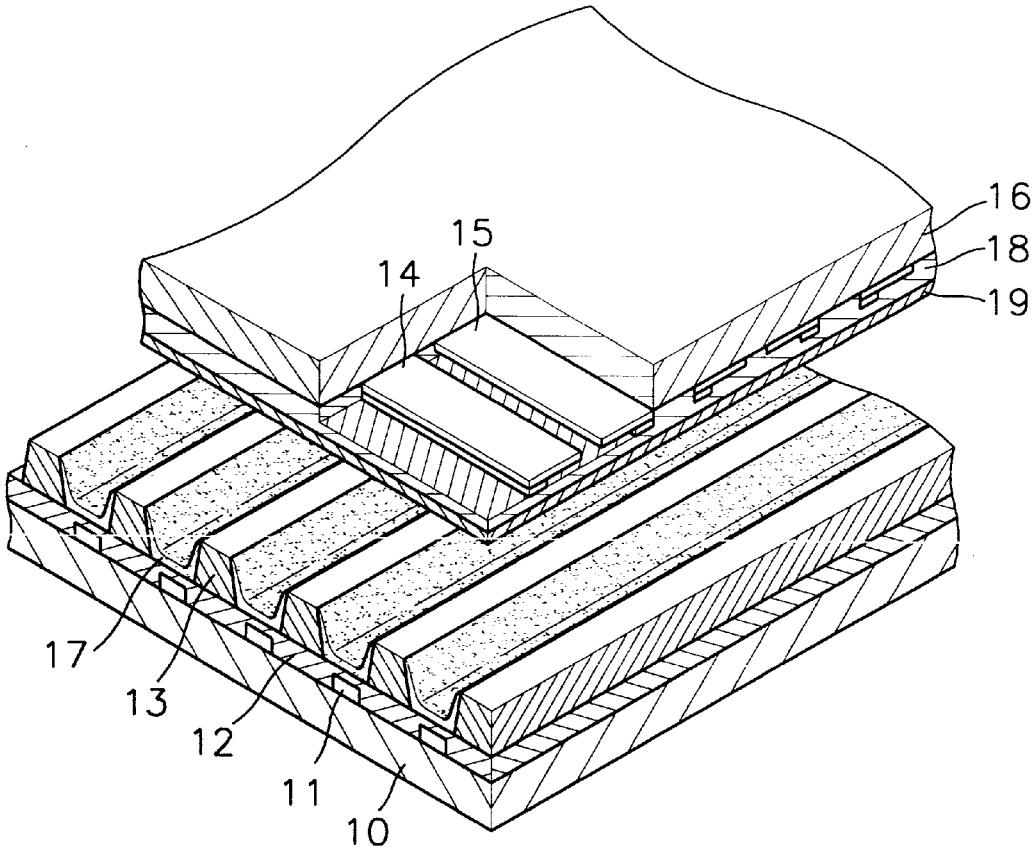
FIG. 1 (PRIOR ART)
FIG. 1 is an exploded perspective view illustrating a conventional plasma display device having a partially cutaway portion.
Figure 2:
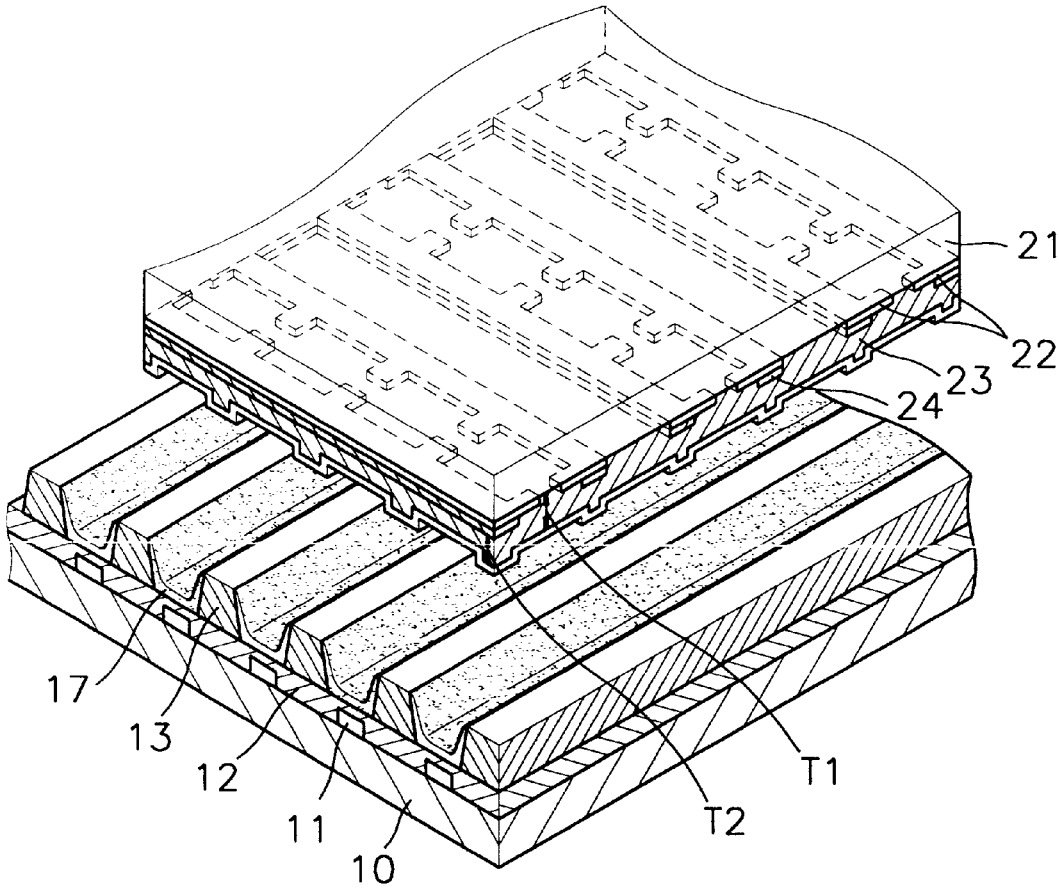
FIG. 2 (PRIOR ART)
FIG. 2 is an exploded perspective view illustrating another example of a conventional plasma display device.
Figure 3:
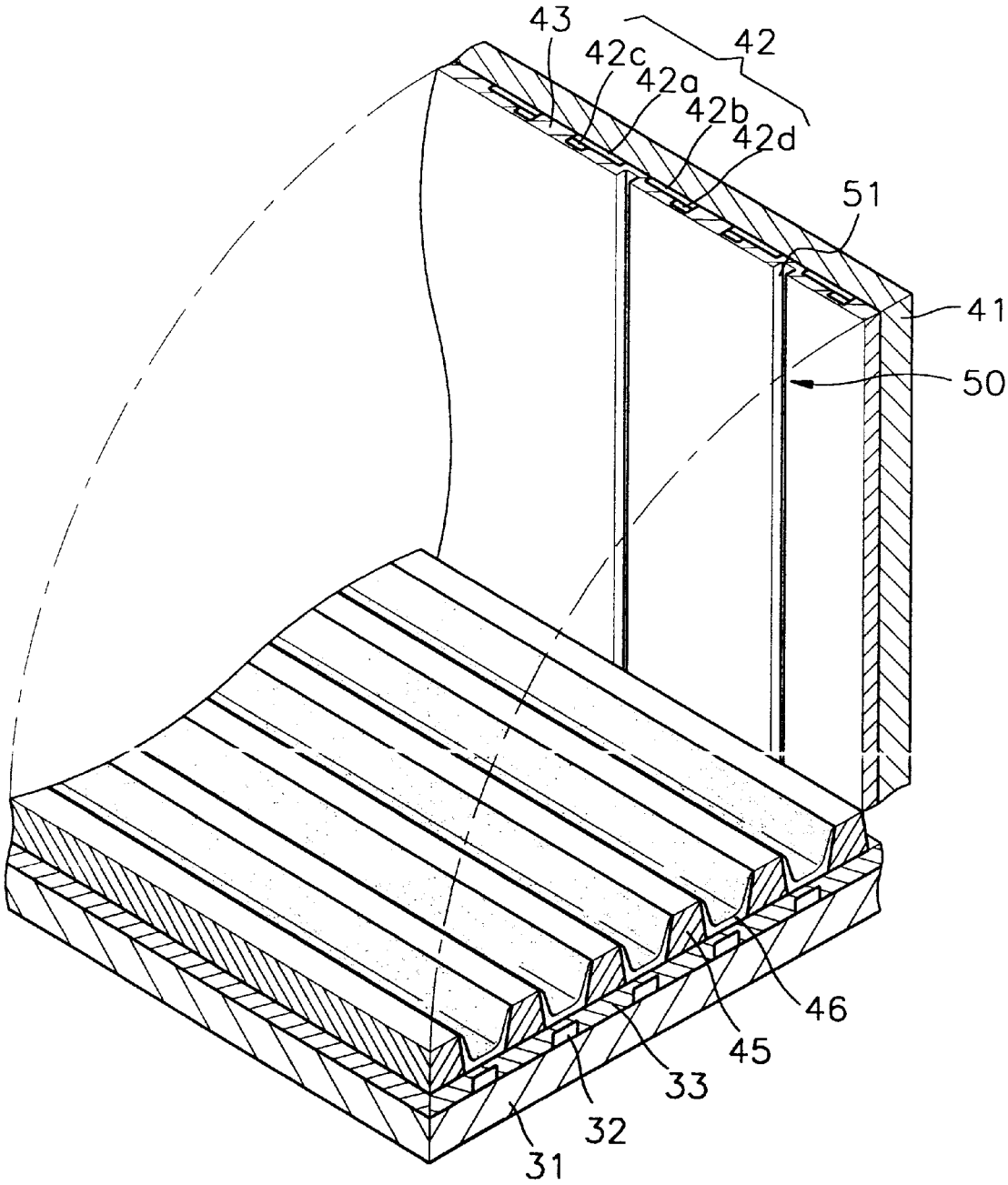
FIG. 3 is an exploded perspective view illustrating a plasma display device according to the present invention.

FIG. 3 shows a plasma display device according to a preferred embodiment of the present invention. As shown in the drawing, the plasma display device according to the present invention includes a first substrate 31, address electrodes 32 formed of a predetermined pattern on an upper surface of the first substrate 32, and a first dielectric layer 33 formed on the first substrate 31 and where the address electrodes 32 are embedded. The address electrodes 32 each having a predetermined width are formed in strips and formed parallel to each other.

The first substrate 31 is coupled to a transparent second substrate 41 to thereby form a discharge space. A plurality of maintaining electrodes 42 formed with several pairs of first and second electrodes 42*a* and 42*b* to be perpendicular to the address electrodes 32 on a lower surface of the second substrate 41 facing the first substrate 31. Here, the maintaining electrodes 42 need not be perpendicular to the address electrodes 32 and the distance between the first and second electrodes 42*a* and 42*b* can be adjusted considering the initial discharge voltage or pixels. The first and second electrodes 42*a* and 42*b* are formed of transparent indium tin oxide (ITO) and bus electrodes 42*c* and 42*d* are formed along the first and second electrodes 42*a* and 42*b*, respectively, to reduce line resistance. The bus electrodes 42*c* and 42*d* are formed of a metal such as silver, silver alloy, or aluminum and the widths thereof are formed to be much narrower than those of the first and second electrodes 42*a* and 42*d*.

A second dielectric layer 43 is formed on the lower surface of the second substrate 41 where the maintaining electrodes 42 are embedded. Partitions 45 for sectioning a discharge space are formed between the first and second substrates 31 and 41 on which the first and second dielectric layers 33 and 43 are formed, respectively. The partitions 45 are formed in a direction parallel to the address electrodes 32. A fluorescent film 46 is formed on a lower surface of a discharge space sectioned by the partitions 45. The partitions 45 are not limited to the above-described preferred embodiment and any structure in which the discharge space is sectioned in a pixel array pattern is possible.

A discharge gas is injected inside a discharge space sectioned by the partition 45. The discharge gas includes Ne and Xe.

Figure 4:
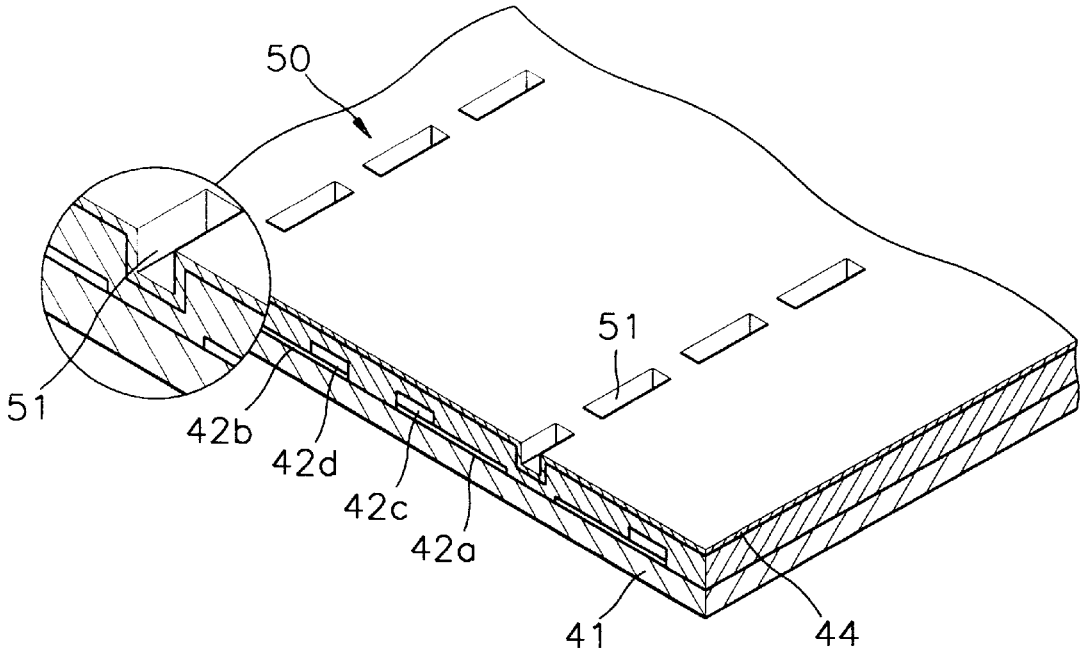
FIG. 4 is a perspective view showing a state in which a portion where an electrical field is concentrated is formed on a dielectric layer formed on a second substriate.

A portion where an electrical field is concentrated 50 is formed between the first and second electrodes 42*a* and 42*b* to lower the initial discharge voltage. The portion 50 where the electrical field is concentrated 50 includes at least one groove 51 having a predetermined depth which is formed in the second dielectric layer 43 between the first and second electrodes 42*a* and 42*b*. The groove 51 can be formed in a continuous pattern or in a discontinuous pattern, as shown in FIG. 4. When the groove 51 is formed in a discontinuous pattern, the groove 51 is preferably disposed inside the discharge space sectioned by the partition 45. A protective film 44 for protecting the second dielectric layer 43 from ions is formed on an upper surface of the second dielectric layer 43 where the groove 51 is formed. The protective film 44 is formed of MgO.

Figure 5:
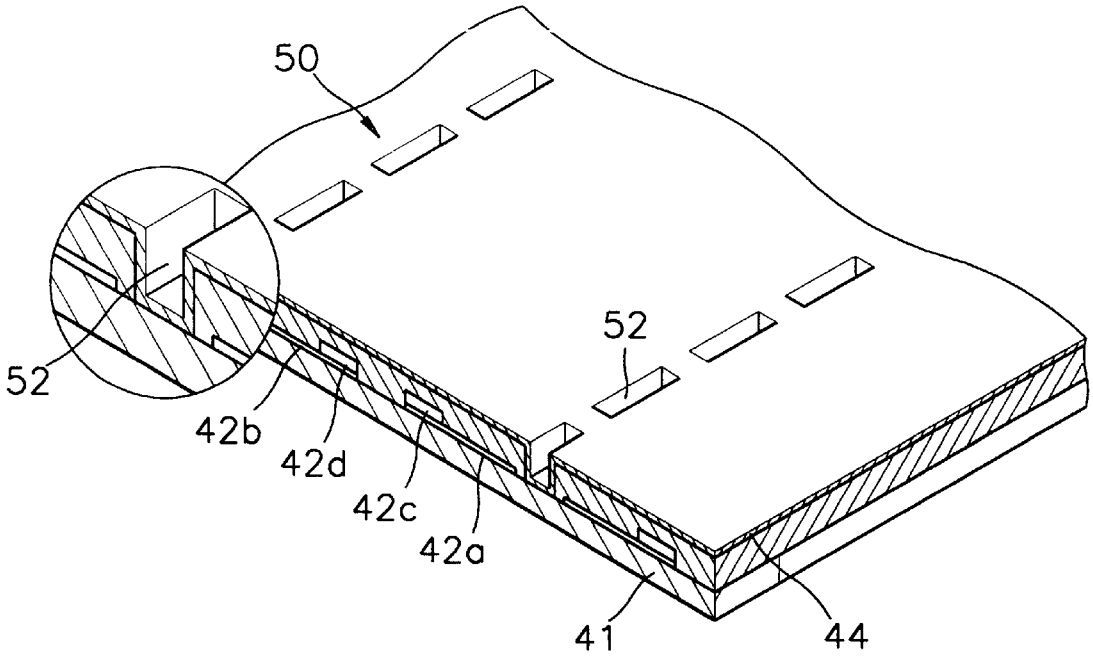
FIG. 5 is a perspective view showing a state in which another example of the portion where an electrical field is concentrated is formed on a dielectric layer formed on a second substrate.

As another preferred embodiment of the portion 50 where an electrical field is concentrated, as shown in FIG. 5, a groove 52 can be formed to expose the second substrate 41 between the first and second electrodes 42*a* and 42*b*. It is preferable in this embodiment that the protective film 44 formed on the upper surface of the second dielectric layer 43 is formed on the surface of the second dielectric layer 43 and the upper surface of the second substrate 41 is exposed by the groove 53. Here, although not shown in the drawing, the groove 52 can be formed in a plurality of rows.

Figure 6:
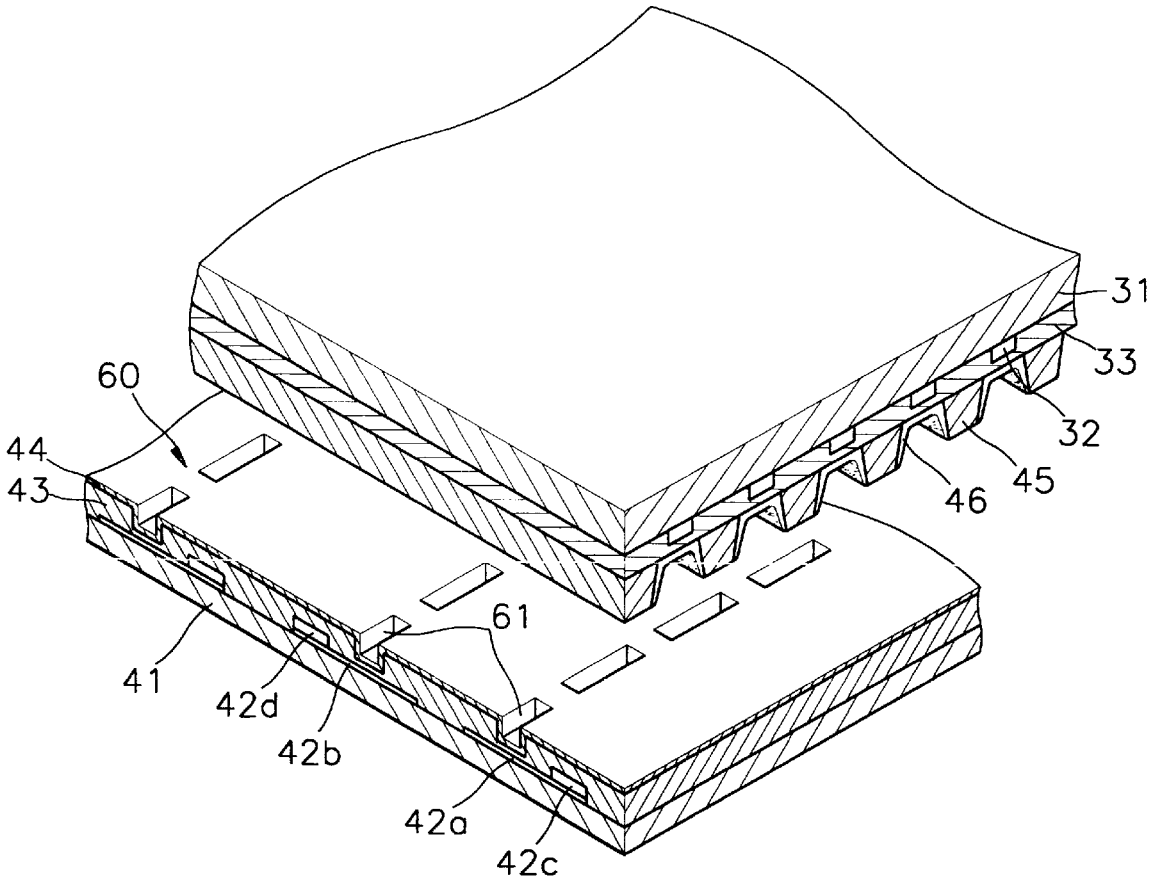
FIG. 6 is an exploded perspective view illustrating another preferred embodiment of the plasma display device according to the present invention.
Figure 7:
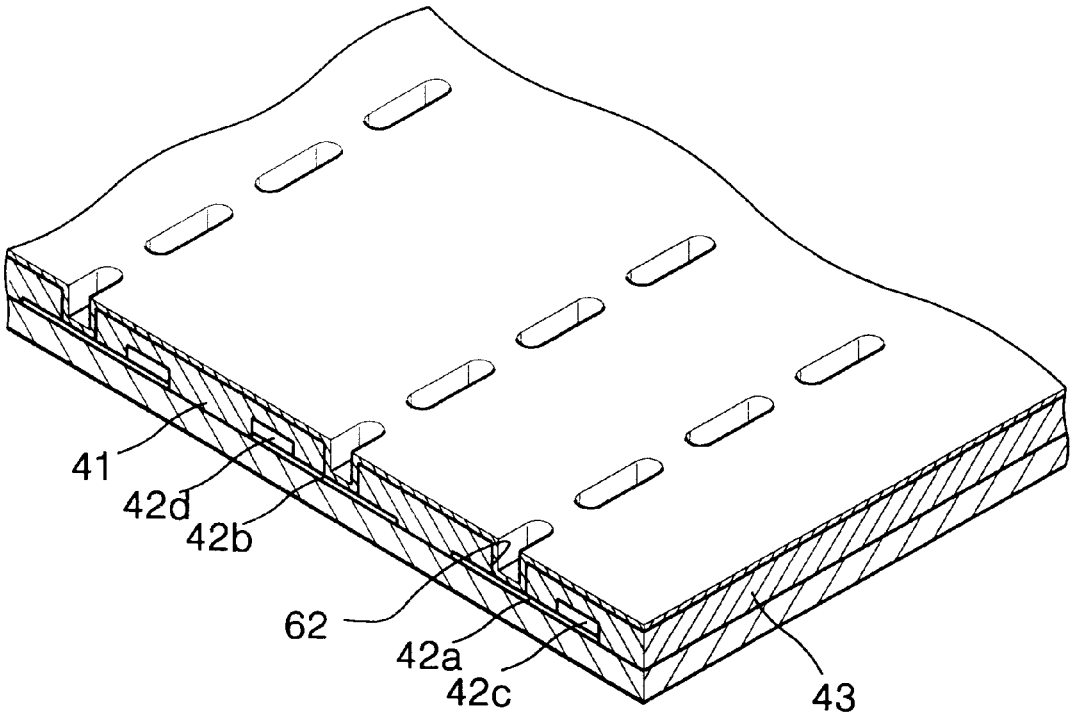
FIG. 7 is a perspective view showing a state in which a portion where an electrical field is concentrated is formed on the dielectric layer formed on the second substrate.

FIG. 6 shows a plasma display device adopting a portion where an electrical field is concentrated according to another preferred embodiment of the present invention. Here, the same reference numerals as those in the description of the above preferred embodiment indicate the same elements. As shown in the drawing, a portion 60 where an electrical field is concentrated is formed on the upper surfaces of the first and second electrodes 42*a* and 42*b*. In the portion 60 where an electrical field is concentrated, a groove 61 having a predetermined depth is formed at at least one side of the second dielectric layer 43 which corresponds to the first and second electrodes 42*a* and 42*b*. The groove 61 can be formed in a continuous pattern or in a discontinuous pattern. A protective film 44 is formed on the upper surface of the second dielectric layer 43 where the groove 61 is formed.

Figure 8:
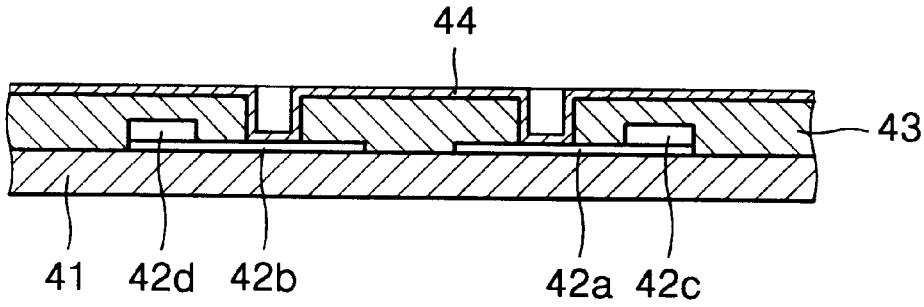
FIG. 8 is a sectional view showing a state in which a portion where an electrical field is concentrated is formed on the dielectric layer formed on the second substrate.

As another preferred embodiment of the portion where an electrical field is concentrated, at least one through-hole 62 is formed at at least one side of the first dielectric layer 44 to correspond to the first and second electrodes 42*a* and 42*b*, such that the first and second electrodes 42*a* and 42*b* are exposed. The through-hole 62 may be formed in a circular or oval shape. When the portion 60 where an electrical field is concentrated is formed in the through-hole 62, the through-hole 62 should be located inside the discharge space sectioned by the partition. A protective film 44 is formed on the upper surface of the second dielectric layer 43 and the upper surfaces of the first and second electrodes 42*a* and 42*b* which are exposed by the through-hole 62, as shown in FIG. 8.

The plasma display device having the above structure according to the present invention operates as follows.

When a predetermined pulse voltage is applied to any of the address electrode 32 and the first and second electrodes 42*a* and 42*b* constituting the maintaining electrode 42, an address discharge is generated therebetween and wall charges are formed on the inner surface of the discharge space. The generated wall charges are filled in the groove 51 formed in the second dielectric layer 43 between the first and second electrodes 42*a* and 42*b* or in the second dielectric layer 43 on the first and second electrodes. In these conditions, when a voltage is applied to the first and second electrodes 42*a* and 42*b*, a maintaining discharge is generated therebetween. The initial discharge voltage for the maintaining voltage can be lowered by the groove 51 and the charges filled therein.

Figure 9:
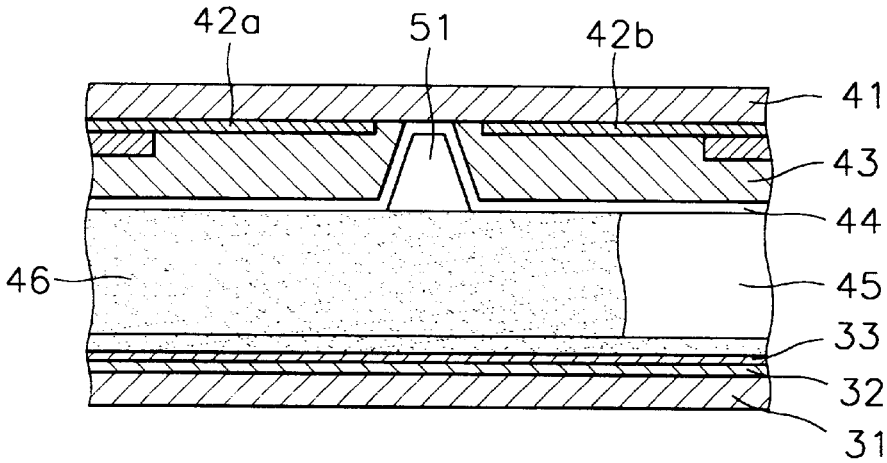
FIGS. 9 through 11 are sectional views showing operational states of a plasma display device according to the present invention.
Figure 10:
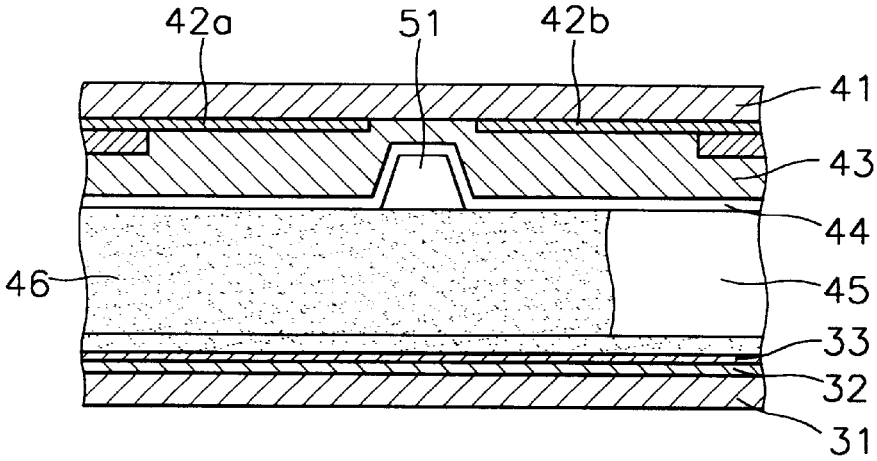

In particular, when the distance between the first and second electrodes 42*a* and 42*b* decreases, the electrostatic capacity becomes greater, whereas, when the distance between the first and second electrodes 42*a* and 42*b* increases, the initial discharge voltage becomes higher. As shown in FIGS. 9 and 10, when the groove 51 is formed and accordingly the second dielectric layer 43 between the first and second electrodes 42*a* and 42*b* is removed or becomes thinner, the electrical field between the first and second electrodes 42*a* and 42*b* is concentrated on the groove 51. Then, discharge is generated from the groove 51 which is filled with charged particles and gas so that the initial discharge voltage can be lowered without increasing the electrostatic capacity. When the groove 51 is formed without a decrease in the distance between the first and second electrodes 42*a* and 42*b*, the effect is a decrease in the distance between the first and second electrodes 42*a* and 42*b* and thus the initial discharge voltage is lowered. In particular, a discharge gas including Xe of 0.1–10% which is injected into the discharge space to achieve a highly efficient discharge causes an increase in the initial discharge voltage. Such an increase can be compensated for by the structure of the groove 51 formed between the first and second electrodes 42*a* and 42*b*. An ultraviolet ray generated during the maintaining discharge excites a fluorescent material to emit light so that an image is formed.

Figure 11:
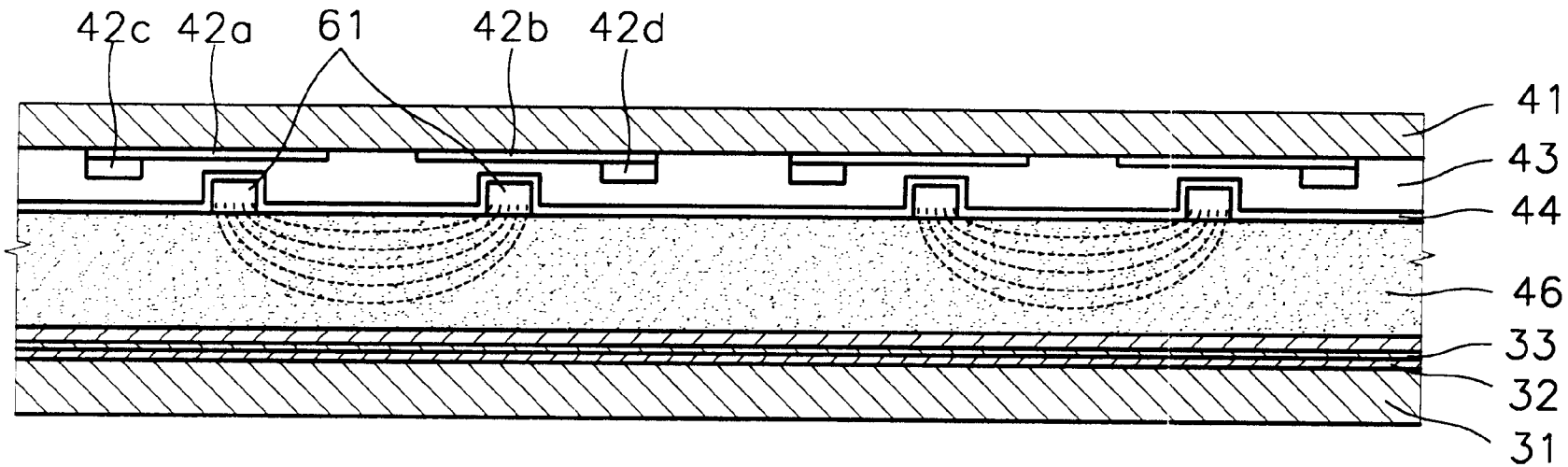

It is obvious that the same operation and function as described above can be obtained when grooves 61 and 62 are formed above the first and second electrodes 42*a* and 42*b*, as shown in FIG. 11.

The method of manufacturing a plasma display device according to the present invention includes a step of forming the second dielectric layer 43 where the portion where an electrical field is concentrated is formed.

Figure 12A:
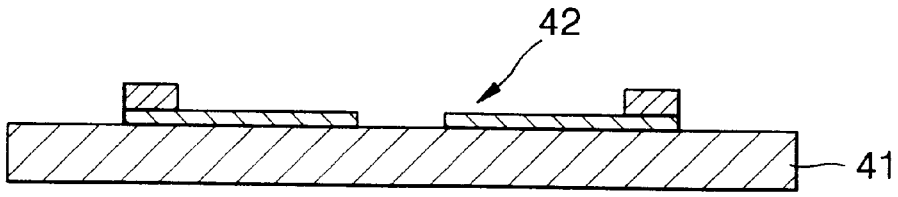
FIGS. 12A through 12C are sectional views for explaining a method of manufacturing the dielectric layer having a portion where an electrical field is concentrated of a plasma display device according to a preferred embodiment of the present invention.
Figure 12B:
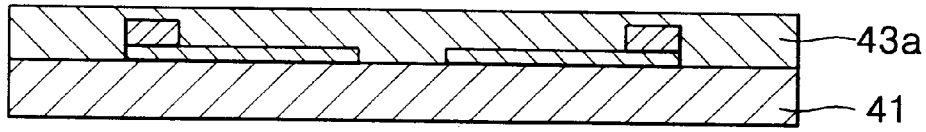
Figure 12C:
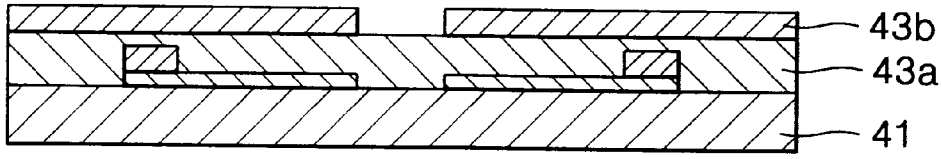

FIGS. 12A through 12C show the method of forming the dielectric layer where the portion where an electrical field is concentrated is formed. As shown in the drawing, the transparent substrate 41 is prepared (Step 1). A plurality of maintaining electrodes 42, each including a pair of the first and second electrodes, is formed on the upper surface of the substrate 41 (Step 2; see FIG. 12A). A lower dielectric layer 43*a* is formed on the upper surface of the substrate 41 where the maintaining electrodes 42 are formed (Step 3; see FIG. 12B). An upper dielectric layer 43*b* is printed on the upper surface of the lower dielectric layer 43*a* such that a groove can be formed between the first and second electrodes or on the first and second electrodes (Step 4; see FIG. 12C). The upper and lower dielectric layers 43*a* and 43*b* are cured after being completely formed (Step 5). The above method of forming the portion where an electrical field is concentrated on the dielectric layer makes it possible for the groove in the portion where an electrical field is concentrated to be formed in a fine pattern.

Figure 13A:
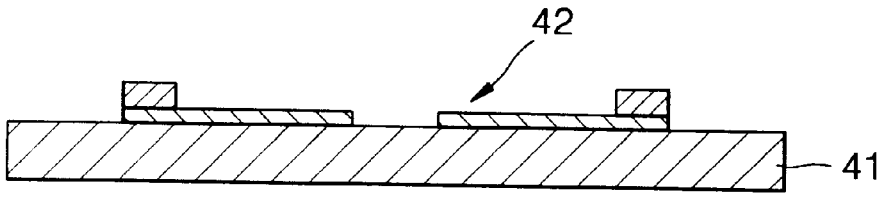
FIGS. 13A through 13C are sectional views for explaining a method of manufacturing the dielectric layer having a portion where an electrical field is concentrated of a plasma display device according to another preferred embodiment of the present invention.
Figure 13B:
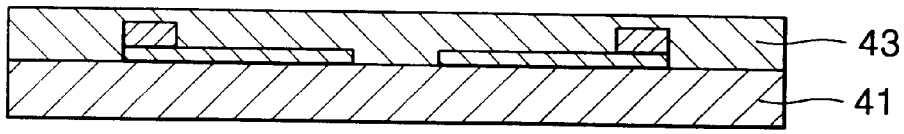
Figure 13C:
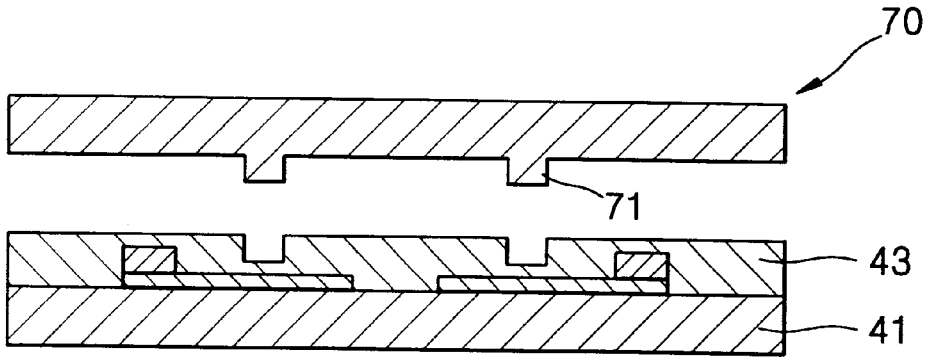

FIGS. 13A through 13C show another preferred embodiment of the method of forming the dielectric layer where the portion where an electrical field is concentrated is formed.

As shown in the drawing, a transparent substrate 41 is prepared (Step 1). A plurality of maintaining electrodes 42, each including a pair of the first and second electrodes, are formed on the upper surface of the substrate 41 (Step 2; see FIG. 13A). A dielectric layer is formed on the upper surface of the substrate 41 where the maintaining electrodes 42 are formed (Step 3; see FIG. 13B). The dielectric layer 43 is made soft by being heated at a predetermined temperature (Step 4). A groove is formed in the softened dielectric layer by pressing a mold 70, in which a protrusion 71 of a pattern corresponding to that of the desired groove is formed, against the upper surface of the softened dielectric layer (Step 5; see 13C). The above method is suitable for mass production since the groove can be formed by pressing a mold against the softened dielectric layer.

As described above, in the method of manufacturing a plasma display device according to the present invention, the portion where an electrical field is concentrated is formed in the dielectric layer between the first and second electrodes. Thus, the initial discharge voltage according to the maintaining discharge can be lowered. As a result, power consumption of the plasma display device can be reduced.

It is noted that the present invention is not limited to the preferred embodiment described above, and it is apparent that variations and modifications by those skilled in the art can be effected within the spirit and scope of the present invention defined in the appended claims.

What is claimed is:

1. A plasma display device comprising:

a first substrate;

an address electrode on an upper surface of said first substrate;

a first dielectric layer on the upper surface of said first substrate and embedding said address electrode;

a second substrate which is transparent and coupled to said first substrate, forming a discharge space between said first and second substrates;

a plurality of maintaining electrodes on a lower surface of said second substrate forming an angle with said address electrode, each of said maintaining electrodes including transparent first and second electrodes;

a second dielectric layer on said second substrate and embedding said maintaining electrodes;

at least one groove in the second dielectric layer where an electrical field is concentrated, the groove being located entirely between said transparent first and second electrodes; and a partition between said first and second substrates defining the discharge space.

2. The plasma display device as claimed in claim 1, wherein the groove between said transparent first and second electrodes has a discontinuous pattern.

3. The plasma display device as claimed in claim 1, wherein the groove between said first and second electrodes has a plurality of rows.

4. The plasma diplay device as claimed in claim 2, wherein said groove formed in a discontinuous pattern is disposed inside the discharge space sectioned by said partition.

5. The plasma display device as claimed in claim 1, including a protective layer on said second dielectric layer and on inner surfaces of the groove.

6. The plasma display device as claimed in claim 1, wherein the groove extends through said second dielectric layer to said second substrate.

7. The plasma display device as claimed in claim 1, wherein the groove extends through only part of said second dielectric layer.

8. A plasma display device comprising:

a first substrate;

an address electrode on an upper surface of said first substrate;

a first dielectric layer on the upper surface of said first substrate and embedding said address electrode;

a second substrate which is transparent and coupled to said first substrate, forming a discharge space between said first and second substrates;

a plurality of maintaining electrodes on a lower surface of said second substrate and forming an angle with said address electrode, each of said maintaining electrodes including transparent first and second electrodes;

a second dielectric layer on said second substrate and embedding said maintaining electrodes;

at least one groove in said second dielectric layer entirely opposite and penetrating to one of said transparent first and second electrodes, and extending in a lengthwise direction of said transparent first and second electrodes, where an electrical field is concentrated; and a partition between said first and second substrates defining the discharge space.

9. The plasma display device as claimed in claim 8, wherein said groove is formed in a discontinuous pattern.

10. The plasma display device as claimed in claim 8, including a protective film on said second dielectric layer.

11. The plasma display device as claimed in claim 8, including a protective film on inner surfaces of the groove and on said second dielectric layer.

* * * * *